US010959510B2

(12) United States Patent
Cho

(10) Patent No.: US 10,959,510 B2
(45) Date of Patent: Mar. 30, 2021

(54) TOOTHBRUSH STRUCTURE

(71) Applicant: David Hyun Jong Cho, Citrus Heights, CA (US)

(72) Inventor: David Hyun Jong Cho, Citrus Heights, CA (US)

( * ) Notice: Subject to any disclaimer, the term of this patent is extended or adjusted under 35 U.S.C. 154(b) by 423 days.

(21) Appl. No.: 14/511,101

(22) Filed: Oct. 9, 2014

(65) Prior Publication Data

US 2016/0100679 A1 Apr. 14, 2016

(51) Int. Cl.
*A46B 11/00* (2006.01)
*A46B 9/02* (2006.01)
*A46B 9/04* (2006.01)

(52) U.S. Cl.
CPC ..... *A46B 9/025* (2013.01); *A46B 9/04* (2013.01); *A46B 11/002* (2013.01); *A46B 11/0062* (2013.01); *A46B 11/0027* (2013.01); *A46B 11/0037* (2013.01); *A46B 2200/1066* (2013.01)

(58) Field of Classification Search
CPC ..... A46B 11/002; A46B 11/0027; A46B 11/0037; A46B 11/0062; A46B 2200/1066; A46B 9/025; A46B 9/04; Y10S 15/05; Y10S 15/06
See application file for complete search history.

(56) References Cited

U.S. PATENT DOCUMENTS 871,121 A * 11/1907 D'Humy ..... A61H 7/003 15/188
1,250,454 A * 12/1917 Heard, Jr. ..... B43K 5/04 401/154
1,268,544 A * 6/1918 Cates ..... A46B 15/0002 15/110
1,711,183 A * 4/1929 Smith ..... A46B 11/0027 132/309
1,753,290 A * 4/1930 Graves ..... A46B 11/0003 15/167.1
2,004,633 A * 6/1935 Miller ..... A46B 9/04 15/167.1
2,168,964 A * 8/1939 Strasser ..... A46B 9/04 15/167.1
2,242,743 A * 5/1941 Brown ..... A46B 9/04 15/167.1
RE22,938 E * 11/1947 Kisky ..... A46B 9/045 15/143.1
2,702,914 A * 3/1955 Kittle ..... A46B 15/00 15/110
3,085,273 A * 4/1963 Cowan ..... A46B 9/04 15/167.1
3,229,318 A * 1/1966 Clemens ..... A46B 9/04 15/167.1
D219,121 S * 11/1970 Krahner ..... D4/104
(Continued)

*Primary Examiner* — Joseph J Hail
*Assistant Examiner* — Arman Milanian
(74) *Attorney, Agent, or Firm* — Innovation Counsel LLP

(57) ABSTRACT

A toothbrush that compensates for a user's toothbrushing technique and cleans the teeth effectively is provided. The toothbrush includes a handle and a head piece. The head piece includes a base supported by a frame, and the base is made of a flexible material. The head piece includes a base having a first surface and an opposing second surface, and a plurality of tooth cleaning elements disposed on the first and second surfaces of the base. The toothbrush further includes cleaning elements that extend from the base at different angles.

16 Claims, 7 Drawing Sheets

(56) References Cited

U.S. PATENT DOCUMENTS 3,722,020 A * 3/1973 Hills ..... A46B 9/045 15/167.1
3,938,897 A * 2/1976 Craig ..... A46B 11/0024 401/155
4,010,509 A * 3/1977 Huish ..... A46B 9/045 15/167.1
4,033,008 A * 7/1977 Warren ..... A46B 9/04 15/167.1
4,051,571 A * 10/1977 Ayers ..... A46B 9/04 15/143.1
4,306,327 A * 12/1981 Zeski ..... A46B 9/04 15/167.1
4,517,701 A * 5/1985 Stanford, Jr. ..... A46B 5/02 15/106
4,570,282 A * 2/1986 Kaufman ..... A46B 9/045 15/167.1
4,706,322 A * 11/1987 Nicolas ..... A46B 9/04 132/309
4,724,570 A * 2/1988 Hitzman ..... A46B 9/04 15/110
4,729,142 A * 3/1988 Yoshioka ..... A46B 9/04 15/167.1
4,963,046 A * 10/1990 Eguchi ..... A46B 9/04 15/167.1
5,046,213 A * 9/1991 Curtis ..... A46B 9/04 15/167.1
5,335,389 A * 8/1994 Curtis ..... A46B 9/04 15/110
5,355,546 A * 10/1994 Scheier ..... A46B 5/0029 15/167.1
5,392,483 A * 2/1995 Heinzelman ..... A46B 9/04 15/167.1
5,544,383 A * 8/1996 Gamble ..... A46B 9/04 15/106
5,839,149 A * 11/1998 Scheier ..... A46B 5/0029 15/167.1
6,108,847 A * 8/2000 Cueman ..... A46B 11/00 15/104.94
6,141,817 A * 11/2000 Dawson ..... A46B 5/0025 15/167.1
6,230,355 B1 * 5/2001 Harada ..... A46B 9/026 15/167.1
6,260,228 B1 * 7/2001 Arroyo-Youngblood ..... A46B 3/20 15/104.001
6,311,358 B1 * 11/2001 Soetewey ..... A46B 9/06 15/110
6,405,401 B1 * 6/2002 Hellerud ..... A46B 9/045 15/167.1
6,408,476 B1 * 6/2002 Cann ..... A46B 5/002 15/167.1
6,564,416 B1 * 5/2003 Claire ..... A46B 9/045 15/167.1
7,814,603 B2 * 10/2010 Gavney, Jr. ..... A46B 15/0002 15/110
7,908,699 B2 * 3/2011 Hohlbein ..... A46B 9/04 15/110
7,934,284 B2 * 5/2011 Braun ..... A46B 15/0002 15/110
8,099,819 B2 * 1/2012 Kraemer ..... A46B 3/04 15/167.1
8,132,284 B1 * 3/2012 Kraemer ..... A46B 3/20 15/167.1
8,239,996 B2 * 8/2012 Garbers ..... A46B 9/04 15/167.1
8,434,190 B2 * 5/2013 Stief ..... A46B 3/16 15/167.1
8,951,045 B1 * 2/2015 White ..... A46B 9/04 15/167.1
9,095,205 B2 * 8/2015 Stofko ..... A46B 5/0054
2005/0268414 A1 * 12/2005 Kim ..... A46B 9/04 15/167.1
2007/0283518 A1 * 12/2007 Blanchard ..... A46B 9/025 15/167.1
2009/0113648 A1 * 5/2009 Vaynberg ..... A46B 9/04 15/143.1
2009/0226241 A1 * 9/2009 McEwen ..... A46B 9/025 401/268
2010/0223745 A1 * 9/2010 Kraemer ..... A46B 9/02 15/167.1
2010/0299857 A1 * 12/2010 Stief ..... A46B 9/025 15/106
2011/0076090 A1 * 3/2011 Wu ..... A46B 11/0006 401/270
2012/0324668 A1 * 12/2012 Stofko ..... A46B 9/025 15/167.1
2013/0061413 A1 * 3/2013 Li ..... A46B 11/0037 15/167.1
2014/0000047 A1 * 1/2014 Boyd ..... A46B 11/0055 15/104.94
2014/0137355 A1 * 5/2014 Lee ..... A46B 9/04 15/167.1

* cited by examiner

TOOTHBRUSH STRUCTURE

TECHNICAL FIELD

The disclosure relates to an oral care device. In particular, the disclosure pertains to a toothbrush that compensates for a user's toothbrushing technique and that can be used to clean teeth effectively without hurting the gum.

BACKGROUND

Oral hygiene is an important part of everyday life. Proper oral hygiene can be achieved using a variety of tools. For example, a toothbrush is used to clean teeth by removing plaque and food debris from the tooth surfaces. When used properly, a toothbrush can effectively remove plaque and food debris from the teeth. Proper use of the toothbrush entails brushing the teeth in an up-down direction while maintaining a substantially constant brush head orientation. Also, proper brushing technique entails avoiding use of excessive force. Since gums have soft tissues, excessively vigorous brushing may cause teeth and gum damage.

Although the teeth cleaning tools available in the market today may clean teeth satisfactorily when used properly, studies have shown that many people do not brush their teeth the proper way. For example, many people tend to brush their teeth in a left-right direction or a pivoted sweeping direction that entails moving just the wrist instead of the whole arm (less arm fatigue). In a conventional toothbrush, the head piece and the handle are typically aligned in a same direction. Hence, the hand or wrist movements described above result in a brush head movement that is sub-optimal for cleaning teeth.

Also, many people often brush their teeth vigorously in an attempt to remove trapped food debris. In a conventional toothbrush, the head piece is typically hard and rigid. As a result, when a user brushes the teeth vigorously with a conventional toothbrush, large stresses may be exerted onto teeth and gum, causing an unnecessary degree of wear and damage. When the toothbrush is used incorrectly, plaque and food debris are not effectively removed, which can lead to plaque buildup, tooth cavities, and toothaches over time. Moreover, vigorous brushing on the gums can hurt the gums and cause gum bleeding.

In a conventional toothbrush, the tooth cleaning elements (e.g. bristles) are typically disposed on only one side of the head piece. The tooth cleaning elements typically have the same length and are oriented perpendicularly to the surface of the head piece. Since all of the tooth cleaning elements have the same length and orientation, the tooth cleaning elements may not be able to effectively clean the inner parts of the teeth that are more difficult to reach. Furthermore, in a conventional toothbrush, the tooth cleaning elements are often densely arrayed on the head piece, which may result in adjacent tooth cleaning elements interfering with each other during brushing. The interference prevents the tooth cleaning elements from reaching between neighboring teeth.

Accordingly, there is a need for a toothbrush that compensates for a user's toothbrushing technique and that can be used to clean the teeth effectively without hurting the gums.

SUMMARY OF THE DISCLOSURE

According to one aspect of the inventive concept, a toothbrush includes a handle and a head piece. The head piece includes a base supported by a frame, wherein the base is made of a flexible material.

According to another aspect, the inventive concept pertains to a toothbrush that includes a handle, a base attached to the handle and including a flexible material, a set of first tooth cleaning elements extending from the flexible material, and a set of second tooth cleaning elements extending from the flexible material, wherein the first and second tooth cleaning elements extend from the flexible material at different angles with respect to the flexible material.

According to yet another embodiment, the inventive concept pertains to a toothbrush that has a handle and a head piece having tooth cleaning elements thereon, wherein the head piece and the handle connect to form an angle θ that is less than 180°.

According to a further embodiment, a toothbrush includes a head piece that has a base and tooth cleaning elements extending from opposing surfaces of the base such that the tooth cleaning elements on two sides of the base are symmetric with respect to the base.

DETAILED DESCRIPTION

Figure 1A:
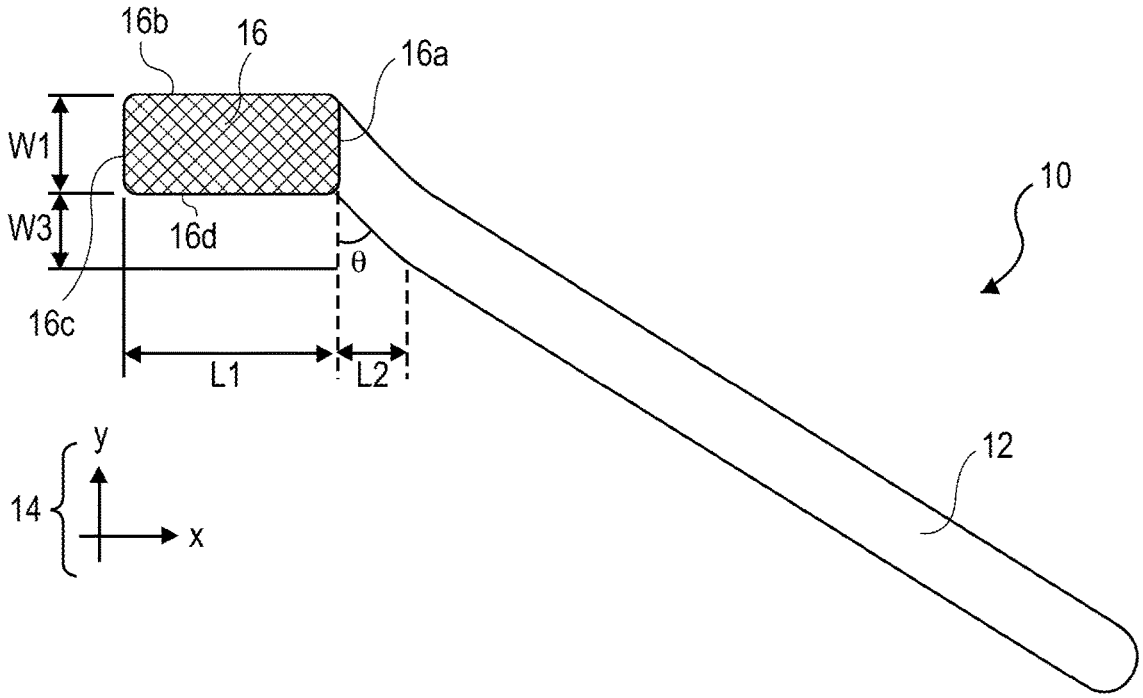
FIG. 1A depicts a side view of a toothbrush in accordance with one embodiment of the inventive concept.

A toothbrush that compensates for a user's toothbrushing technique and that can be used to clean the teeth effectively without hurting the gums is presented. While the disclosure focuses on a few embodiments of the inventive concept for clarity and simplicity of illustration, it should be understood that the embodiments shown here are not exhaustive and there are many other ways in which the inventive concept may be practiced.

In this disclosure, like reference numerals in the drawings denote like elements, and thus a repeated description of those similar elements will be omitted. Also, it will be understood that although the terms "first", "second", etc. may be used herein to describe various components, the components should not be limited by those terms. Instead, those terms are merely used to distinguish one component from another. A "toothbrush," as used herein, is intended to mean an oral care device. A "set," as used herein, is intended to mean one or more.

FIG. 1A depicts a side view of a toothbrush 10 in accordance with one embodiment. The toothbrush 10 includes a handle 12 and a head piece 16. A side 16*a* of the rectangular base 18 interfaces with the handle 12. The head piece 16 is connected to the handle 12 to form an angle θ, wherein θ is less than 180°. Specifically, where the side 16*a* extends along a y-axis of a coordinate 14, the handle 12 extends to form an angle θ with respect to the side 16*a*. In one embodiment, the angle θ may range from about 20° to about 50°. In another embodiment, the angle θ may be about 35°. In some embodiments, the head piece 16 may be connected to the handle 12 by a neck section (not shown in Figures).

The head piece 16 has a head width W1 and a head length L1 as shown in FIG. 1A. The head width W1 and the head length L1 may be the same or different. In one embodiment, the head width W1 may be about 10-20 mm and the head length L1 may be about 20-40 mm. In another embodiment, the head width W1 may be about 15 mm and the head length L1 may be about 30 mm. Where there is a neck section, the neck section may have a neck width W3 and neck length L2, wherein the neck width W3 may be about 8-18 mm and neck length L2 may be about 5-13 mm. In another embodiment, the neck width W3 may be about 13 mm, and the neck length L2 may be about 9 mm.

In one embodiment, the handle 12 and head piece 16 may be different components that are assembled together to form the toothbrush 10. In another embodiment, the handle 12 and head piece 16 may be formed integrally as one continuous piece, for example, by using an injection molding process. In yet another embodiment, the handle 12 and the neck section may be formed integrally and the head piece 16 may be a separate component that is made attachable to the neck section.

The handle 12 enables a user to readily grip and manipulate the toothbrush 10. In the embodiment of FIG. 1A, the handle 12 is formed having a rod-like shape. However, it is noted that the handle 12 may be formed of many different shapes and constructions. For example, the handle 12 may be ergonomically shaped to fit a user's hand. The handle 12 may be made of materials such as plastic, for example, polypropylene. The handle 12 may be formed as a solid body.

Figure 1B:
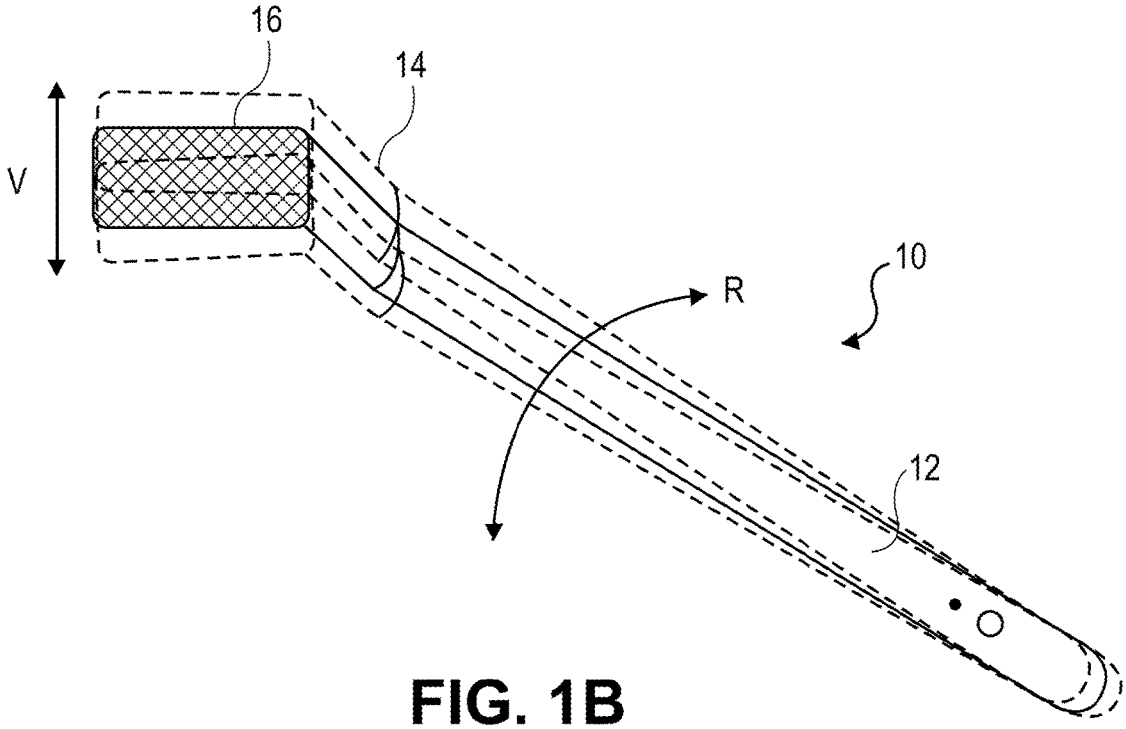
FIG. 1B illustrates the range of motion of the head piece when the exemplary toothbrush is used in a pivoted sweeping direction.

FIG. 1B illustrates the range of motion of the head piece 16 when the toothbrush 10 is used in a pivoted sweeping direction R about a pivot point O. Referring back to FIG. 1A, the handle 12 and the head piece 16 are joined at an angle θ relative to the handle 12. In some embodiments, the angle θ may be adjustable according to a user's preference, perhaps within a limited range. In those embodiments, there may be a neck section that serves as a swivel, allowing the head piece 16 to be tilted at different angles relative to the handle 12. For example, in some embodiments, the neck section may include a ball-and-socket joint that can be locked in place (and unlocked to adjust to a different angle). Any combination of different swiveling and locking mechanisms may be used to rotate the head piece 16 and lock it in place.

As mentioned above, using incorrect brushing techniques with a straight, conventional toothbrush results in sub-optimal teeth cleaning. The angle θ of the toothbrush 10 translates the same left-right hand movement or up-and-down pivoting of the wrist into a movement of a headpiece 16 that is optimal for cleaning teeth.

In more detail, in the embodiment of FIGS. 1A and 1B, the pivot arm (handle 12) is long, and the head piece 16 is tilted at an angle θ relative to the handle 12 and located far away from the pivot point O (the user's hand), which thus reduces the angular motion of the head piece 16. As a result, the head piece 16 moves in a substantially up-down vertical direction V even though the handle 12 is rotating in the pivoted sweeping direction R. As previously mentioned, proper tooth brushing entails brushing the teeth in an up-down direction so that the bristles of the toothbrush can reach into the gaps between the teeth and remove trapped food debris. Accordingly, the exemplary toothbrush 10 compensates for a user's sub-optimal brushing technique and can be used to clean teeth effectively.

Next, the head piece 16 will be described in further detail. FIGS. 2A, 2B, 2C, and 2D depict one embodiment of the head piece 16 wherein tooth cleaning elements 22 are present on one side of the base 18. The head piece 16 includes a base 18 made of a flexible material supported by a frame 20. The frame 20 may be rigid. A part of the frame 20 that makes up the side 16*a* (see FIG. 1A) interfaces with the handle 12 or the neck section, if there is one. The base 18 has a first face 18*a* and an opposite second face 18*b*. The tooth cleaning elements 22 may include filament bristles or elastomeric fingers that are used for wiping and cleaning the user's teeth. Other types of tooth cleaning elements known in the art may be used as desired.

In contrast to the rigid head piece of a conventional toothbrush, the base 18 of the toothbrush 10 is made of a flexible material such as elastomers. For example, the base 18 may include silicone. Since the base 18 is supported by the frame 20, the base 18 behaves like a membrane and flexes in response to a force applied during brushing. Accordingly, less stress is exerted onto the user's teeth and gums when brushing using the toothbrush 10 (compared to using a conventional toothbrush having bristles on a hard surface that hardly "gives"). Even if the user applies too much force, the flexible base 18 will prevent all of the force from reaching the teeth. As a result, tooth wear and gum damage can be minimized using the exemplary toothbrush 10.

Figure 2A:
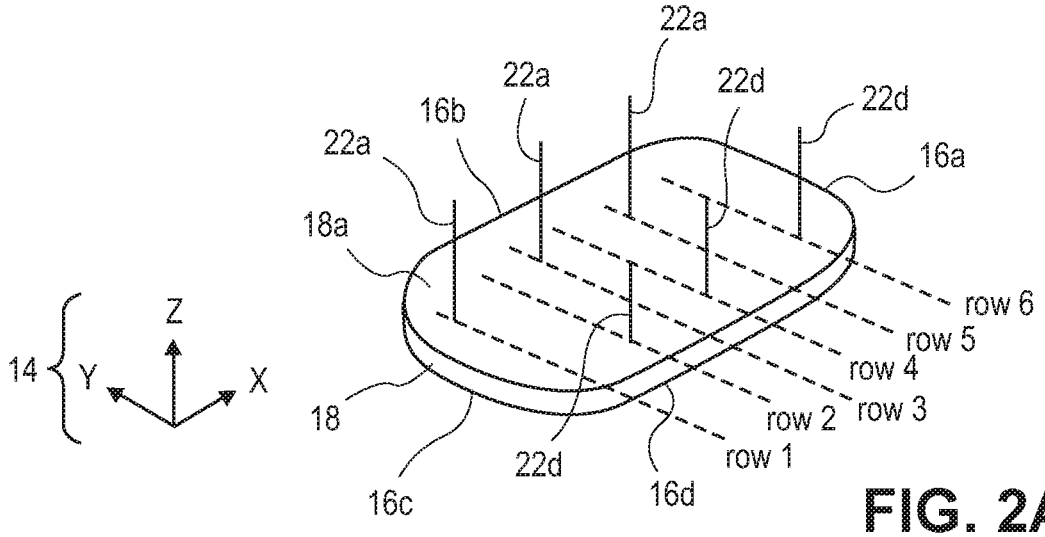
FIG. 2A depicts a perspective view of the head piece with tooth cleaning elements in accordance with one embodiment.

In the embodiment of FIGS. 2A, 2B, 2C, and 2D, the tooth cleaning elements 22 are disposed on one side of the base 18, the first face. The tooth cleaning elements 22 include first cleaning elements 22*a*, second cleaning elements 22*b*, third cleaning elements 22*c*, and fourth cleaning elements 22*d*. In the depicted embodiment, the first cleaning elements 22*a* are arranged along a second side 16*b* of the head piece 16, substantially in a straight line. The fourth cleaning elements 22*d* are arranged along a fourth side 16*d* of the head piece 16, also substantially in a straight line. However, the first cleaning elements 22*a* and the second cleaning elements 22*d* are arranged in a staggered configuration, such that they are not directly across the base 18 from each other. In other words, where there are imaginary "rows" extending across the base 18 parallel to the first side 16*a* (as shown in FIG. 2A), the first cleaning elements 22*a* and the fourth cleaning elements 22*d* would be on alternating rows. In the example of FIG. 2A, the first cleaning elements 22*a* are formed on odd-numbered rows (row 1, row 3, row 5), and the fourth cleaning elements 22*d* are formed on even-numbered rows (row 2, row 4, row 6). The first and fourth cleaning elements 22*a*, 22*d* extend straight up from the base 18, substantially orthogonally to the first face 18*a*. The first and fourth cleaning elements 22*a*, 22*d* may all have the same length or have varying lengths.

Second cleaning elements 22*b* and the third cleaning elements 22*c* are arranged near the center portion of the base, between the line formed by the first cleaning elements 22*a* and the line formed by the fourth cleaning elements 22*d*.

Figure 2B:
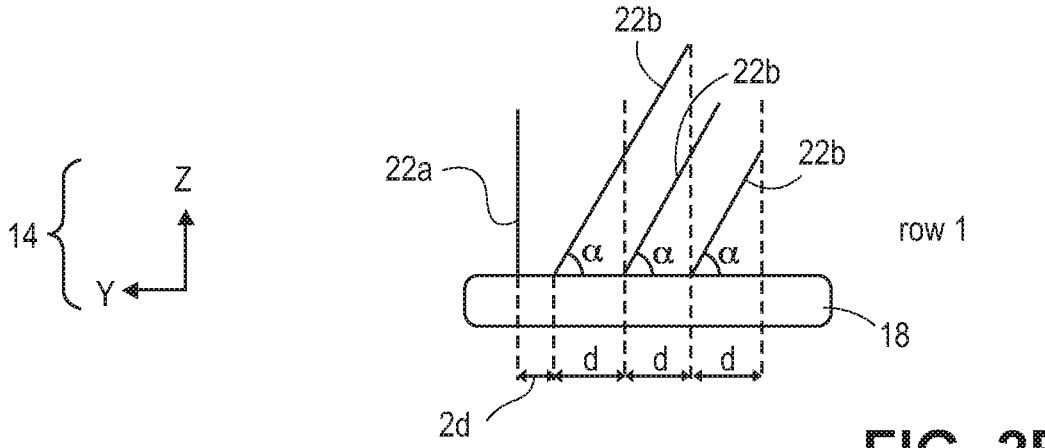
FIG. 2B, FIG. 2C, and FIG. 2D depict side views of the head piece of FIG. 2A.

FIG. 2B depicts side view of row 1, which includes one of the first cleaning elements 22*a* and some of the second cleaning elements 22*b*. The second cleaning elements 22*b* are separated from each other by a distance d. The second cleaning element 22*b* that is next to the first cleaning element 22*a* in the same row may be separated from the first cleaning element 22*a* by a distance 2*d*. The second cleaning elements 22*b* incline away from the first cleaning element 22*a*, forming an angle α with respect to the base 18 as shown in FIG. 2B. The angle α may range from 20° to 70°. The second cleaning elements 22*b* may all have the same length or different lengths. Where the second cleaning elements 22*b* have different lengths, the length should increase/decrease in the y-direction to form a rooftop outline 23 as shown below in FIG. 2D.

Figure 2C:
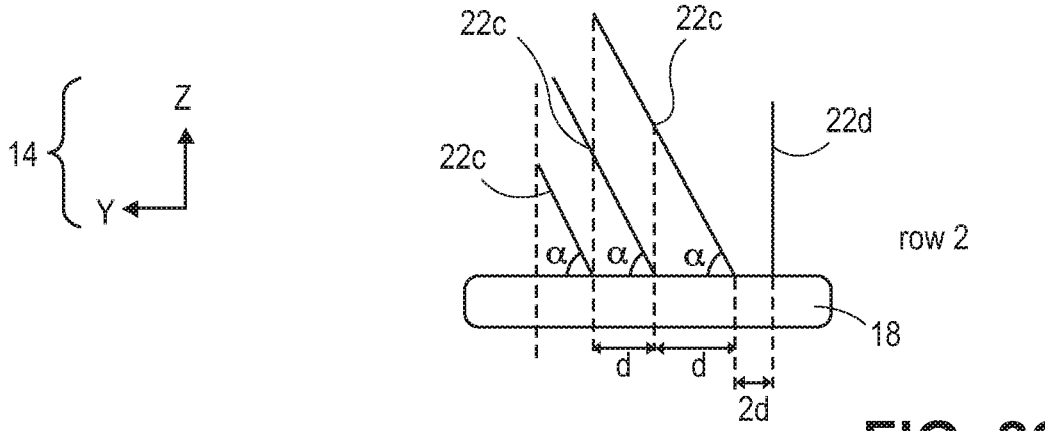

FIG. 2C depicts a side view of row 2 in the head piece 16 of the embodiment of FIG. 2A. As explained above in reference to FIG. 2A, row 2 has a fourth cleaning element 22*d* but not a first cleaning element 22*a*. The third cleaning elements 22*c* incline away from the fourth cleaning elements 22*d* in the same row, forming an angle of (180-α) with respect to the base 18 as shown in FIG. 2C. The third cleaning elements 22*c* are separated from each other by a distance d. The third cleaning element 22*c* that is next to the fourth cleaning element 22*d* in the same row may be separated from the fourth cleaning element 22*d* by a distance 2*d*.

Figure 2D:
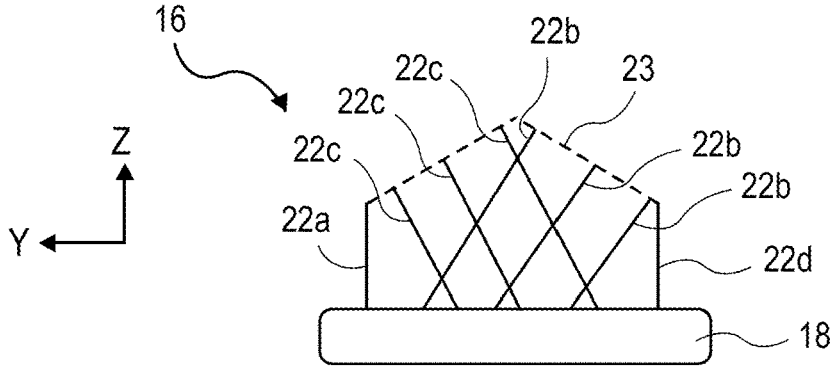

Odd-numbered rows arranged like row 1 of FIG. 2B and even-numbered rows arranged like row 2 of FIG. 2C alternate across the length of the head piece 16 in the x-direction. Although six rows are shown in FIG. 2A, this is just one embodiment and more or fewer rows may be formed. FIG. 2D depicts a side view of the head piece 16. As shown, the second cleaning elements 22*b* and the third cleaning elements 22*c* form a crisscross pattern having a rooftop outline 23 (shown with a broken line) when seen from the y-z plane. The rooftop outline 23 includes two lines coming together at an angle to form an apex. The apex extends along a center of the headpiece 16, in the x-direction.

Figure 3B:
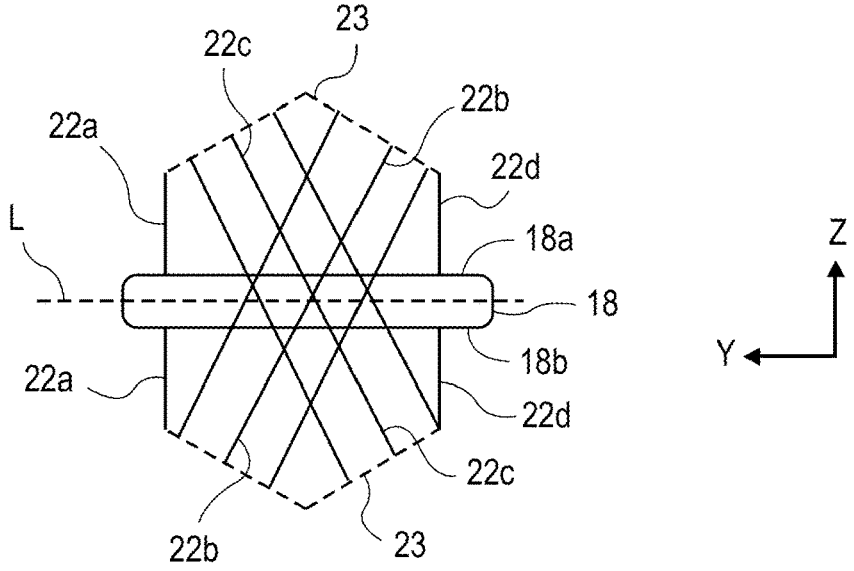
FIG. 3A and FIG. 3B depict a head piece with tooth cleaning elements in accordance with another embodiment.
Figure 3A:
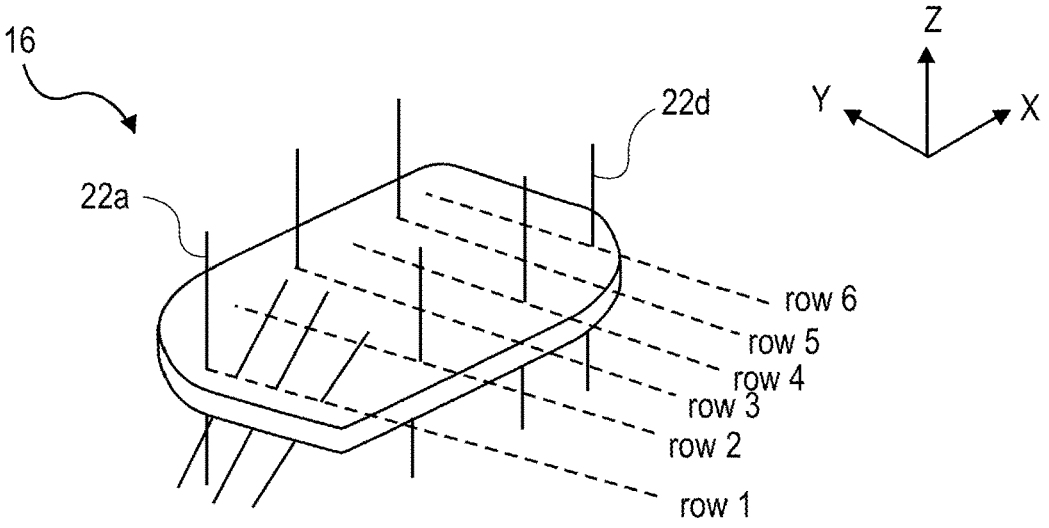

FIG. 3A and FIG. 3B depict another embodiment of the head piece 16 in accordance with the inventive concept. FIG. 3A depicts a side view of the head piece 16 in accordance with another embodiment, and FIG. 3B depicts a cross sectional view of the embodiment shown in FIG. 3A. In this embodiment, the tooth cleaning elements 22 are disposed on both the first and second faces 18*a*, 18*b* of the base 18. The tooth cleaning elements 22 on the second face 18*b* may be arranged similarly to the tooth cleaning elements 22 on the first face 18*a*. The tooth cleaning elements 22 on the first face 18*a* and the second face 18*b* may be arranged symmetrically with each other, with respect to a center line L extending in the y-direction through the head piece 16, as depicted in FIG. 3B.

In the embodiment of FIG. 3A and FIG. 3B, tooth cleaning elements 22 extend from the first face 18*a* and the second face 18*b* in opposite directions. In more detail, both the first face 18*a* and the second face 18*b* include first tooth cleaning elements 22*a* and fourth cleaning elements 22*d* disposed orthogonally to the first face 18*a* and the second face 18*b*. The second tooth cleaning elements 22*b* may be disposed at an angle α relative to the first face 18*a* and the second face 18*b*. The third tooth cleaning elements 22*c* may be disposed at an angle (180-α) relative to the first face 18*a* and the second face 18*b*.

In the embodiments of FIGS. 2B, 2C, 2D, 3A, and 3B, the second cleaning elements 22*b* are all inclined at about the same angle α and the third cleaning elements 22*c* are all inclined at about the same angle (180-α). However, these embodiments are just examples and there may be other embodiments where tooth cleaning elements are inclined at different angles.

Figure 4:
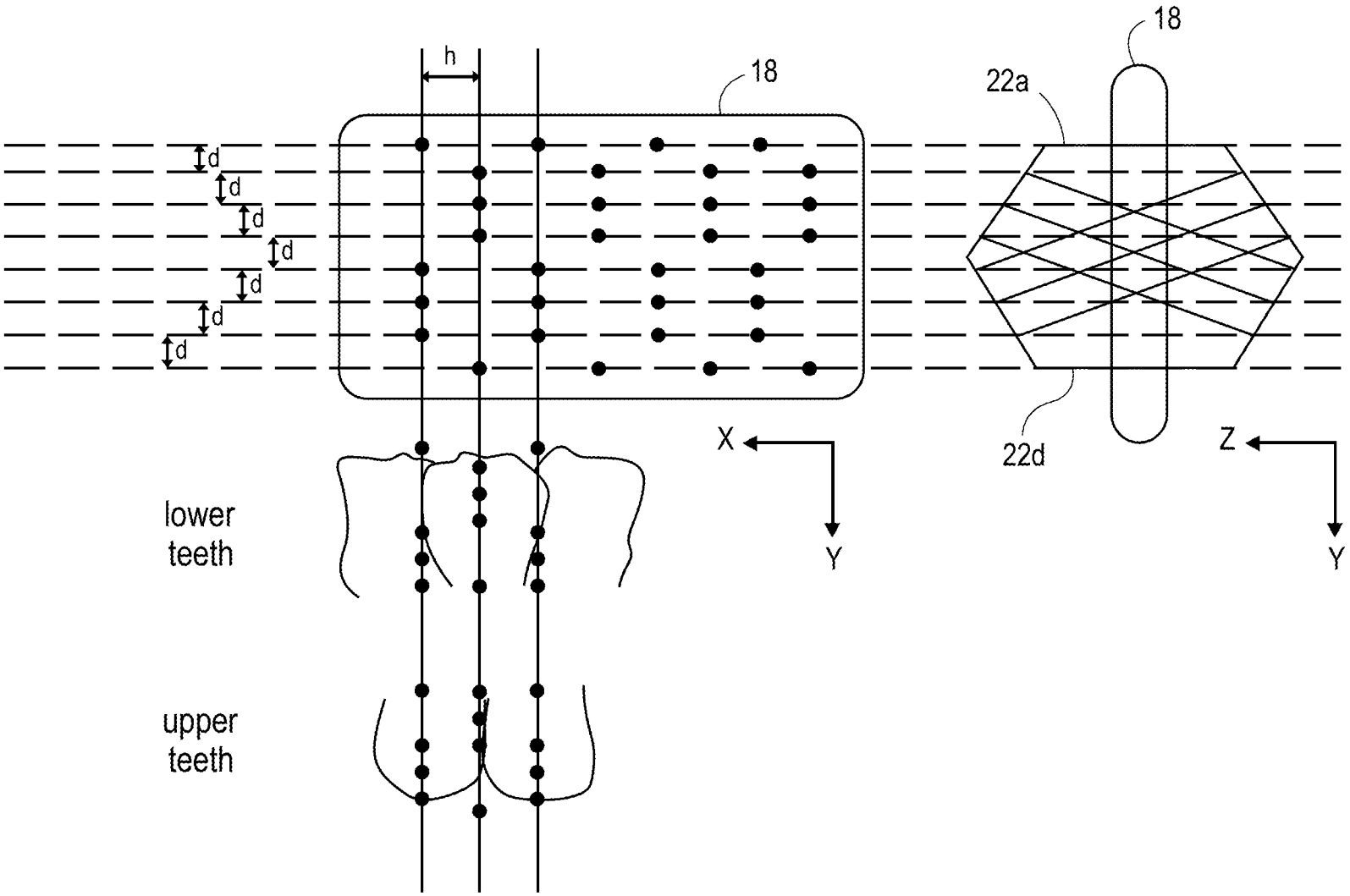
FIG. 4 depicts a layout of the tips of the tooth cleaning elements.

FIG. 4 depicts a layout of the tips of the tooth cleaning elements 22 along an x-y plane, "tips" being the ends that are farthest from the base 18. The dots shown in FIG. 4 mark where the tips of the tooth cleaning elements 22 would contact the surface(s) being cleaned, such as teeth. As shown, tips of the first cleaning elements 22*a* and fourth cleaning elements 22*d* touch the surface being cleaned along two parallel sides 16*b*, 16*d* of the head piece 16 in alternating rows. The separation distance h between adjacent rows may be such that when odd-numbered rows align with the boundary between two neighboring teeth, the even-numbered rows align with ridges of the teeth. This separation distance h may be between 2-3 mm. Depending on whether the top teeth or the bottom teeth are being cleaned, either the first cleaning elements 22*a* or the fourth cleaning elements 22*d* would contact an area where teeth meet the gum and clean the gum line. Hence, an up-and-down movement of the head piece 16 results in the cleaning elements 22 simultaneously cleaning the teeth ridge, the area of the teeth near the gum line, and the area between teeth. As shown, the tip arrangement works for both lower and upper teeth. The second cleaning elements 22*b* that contact the ridge portion of upper teeth contacts the area between teeth when used on the lower teeth. Similarly, the third cleaning elements 22*c* that contact the area between neighboring upper teeth contacts the ridge portion when used on the lower teeth.

The density of tooth cleaning elements 22 on the brushing surface of the head piece 16 is much lower than the density of bristles on a conventional toothbrush head (i.e., fewer tooth cleaning elements per unit area compared to a conventional toothbrush). As a result, there is less interference between adjacent tooth cleaning elements 22 during brushing. Accordingly, the tooth cleaning elements 22 can clean teeth more effectively than the tooth cleaning elements in a conventional toothbrush.

Figure 5:
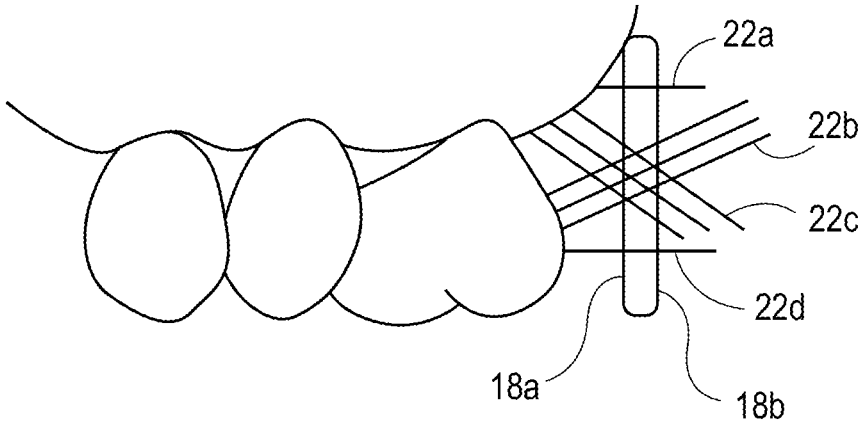
FIG. 5 depicts the toothbrush of FIG. 3A being used.

FIG. 5 depicts the toothbrush of FIG. 3A being used. As shown, the second tooth cleaning elements 22*b* and third tooth cleaning elements 22*c* extending from the first face 18*a* may simultaneously clean the teeth and massage the gum, respectively. At the same time, the tooth cleaning elements 22 on the second face 18*b* massages the inner cheek area of the mouth.

Since the tooth cleaning elements 22 are disposed on opposite faces 18*a*, 18*b* of the head piece 16, a user may alternate between the tooth cleaning elements 22 on the first/second faces 18*a*/18*b* for brushing the facial side and lingual side of the same set of teeth with substantially the same arm motion. The arrangement of the tooth cleaning elements 22 on the two sides of the base allow the tooth cleaning elements 22*a* to reach into crevices between teeth from either the facial side or the lingual side.

It should be noted that the inventive concept is not limited to the above-described embodiments. For example, the length, orientation, layout, density, and material of the tooth cleaning elements 22 may be modified in different ways to optimize cleaning effect on the teeth (and also the massaging effect on the gums and wall of the mouth).

Figure 6A:
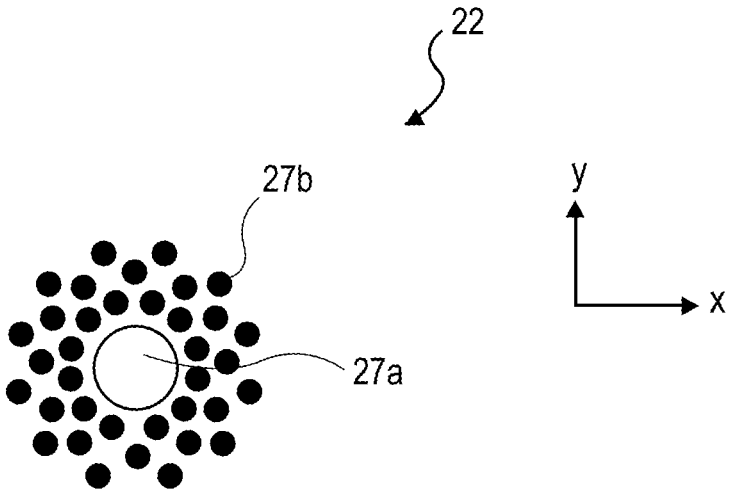
FIG. 6A depicts a top view of tooth cleaning elements in accordance with an embodiment of the inventive concept.

FIG. 6A depicts a cross-sectional view of a single tooth cleaning element 22 sliced along the x-y plane. Referring to FIG. 6A, the tooth cleaning element 22 includes a core 27*a* and a plurality of bristles 27*b* surrounding the core 27*a*. The core 27*a* may be a rubber post, while the bristles 27*b* may be made of the same type of material as in a conventional toothbrush. As shown in FIG. 6A, the core 27*a* is thicker than a bristle 27*b* (the diameter of the core 27*a* is greater than the diameter of a bristle 27*b*). In one embodiment, the core 27*a* may be 1-3.5 mm in cross-sectional diameter, and the bristles about 1 mm±0.2 mm. Accordingly, the core 27*a* increases the rigidity of the tooth cleaning element 22, thereby extending its useful life. In other embodiments, there may not be a core 27*a* but just bristles 27*b* as in a conventional toothbrush.

Figure 6B:
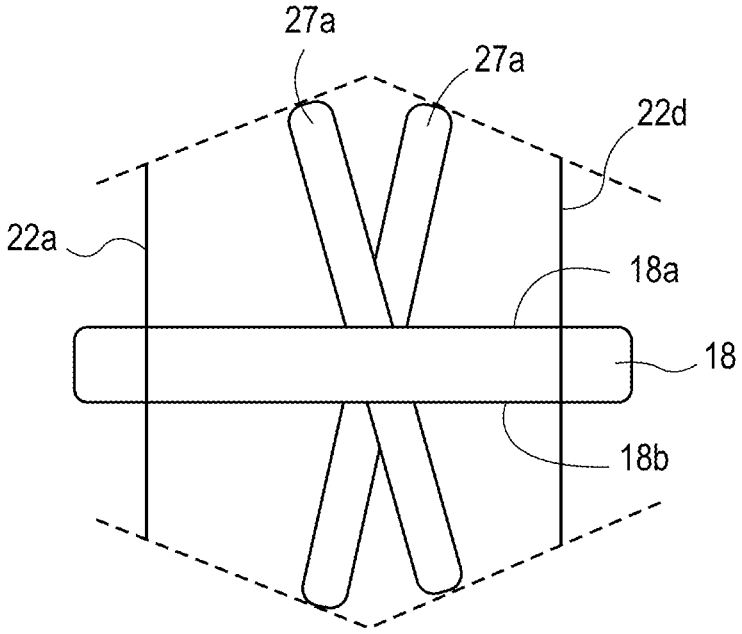
FIG. 6B depicts a side view of the tooth cleaning elements in accordance with another embodiment.

FIG. 6B depicts a cross sectional view of an alternative embodiment of the tooth cleaning elements 22. In this embodiment, there are a plurality of cores 27*a*, which may be rubber posts, arranged to extend at an angle (e.g., angle α) with respect to the base 18. The rubber posts may be about 2.5 to 3.5 mm in cross sectional diameter. In some embodiments, the rubber posts may each have a cross sectional diameter of about 3 mm. Although only two rubber posts are shown to extend out of the base 18 on each surface 18*a*/18*b*, this is for simplicity of illustration and a plurality of such arrangements may be made between the first and second cleaning elements 22*a*, 22*b*. Where there are multiple rubber posts arranged, their lengths may vary so as to form the rooftop outline 23 (see FIG. 3B). The rubber posts are thicker than the first tooth cleaning elements 22*a*.

Figure 7A:
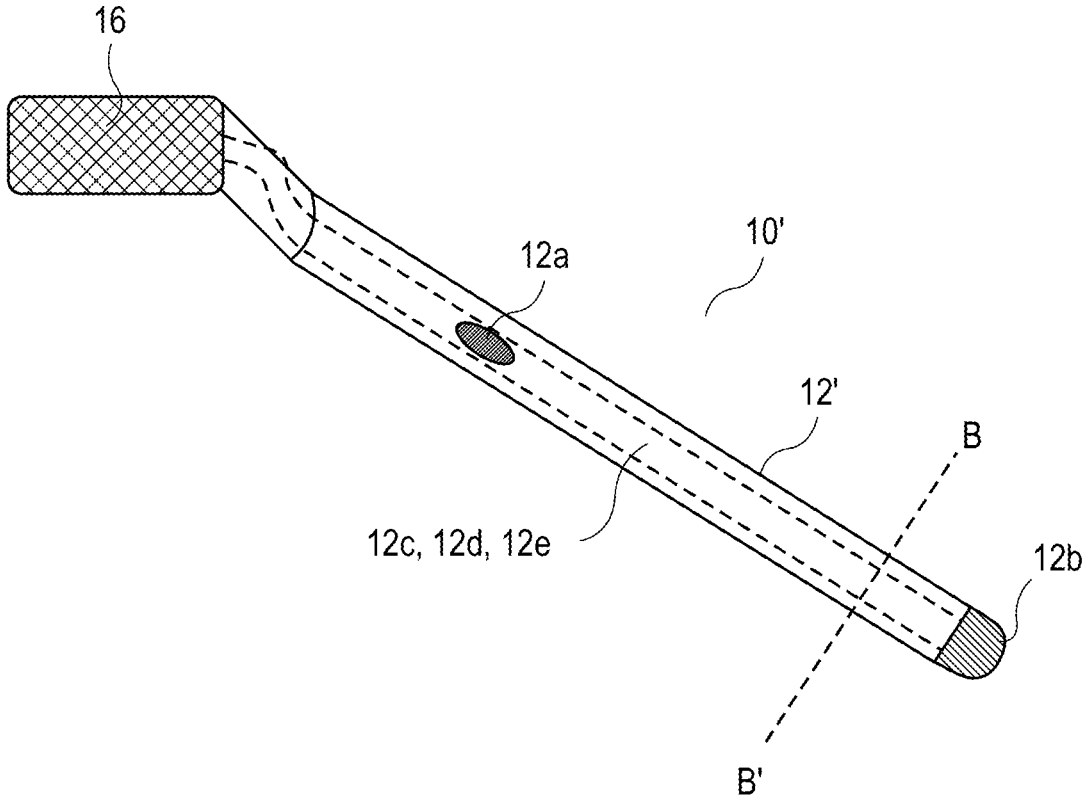
FIG. 7A depicts a toothbrush in accordance with an embodiment that includes a compartment extending through the handle.

FIG. 7A depicts a side view of a toothbrush 10' in accordance with another embodiment.

The embodiment of FIG. 7A is similar to the embodiment of FIG. 1A except for the following differences. In the embodiment of FIG. 7A, the handle 12' has a hollow compartment inside designed to hold toothpaste or tooth whitener refills. There may be two compartments, one holding toothpaste and another one holding whitener refills. A cavity extends through the neck section, allowing the toothpaste and tooth whitener to travel toward the head piece 16. There is an outlet on or near the head piece 16, such that the toothbrush 10' in FIG. 7A can be operated to dispense a desired amount of toothpaste and tooth whitener as a user is brushing his teeth.

Figure 7B:
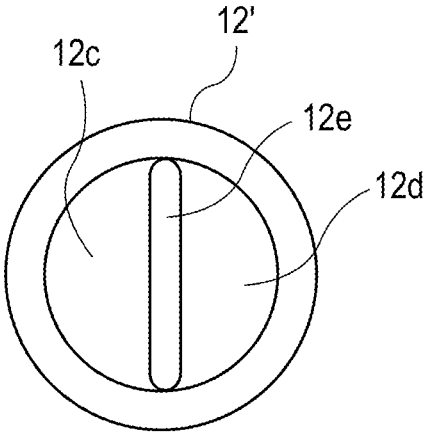
FIG. 7B and FIG. 7C depict cross sectional views of a toothbrushes in accordance with different embodiments.
Figure 7C:
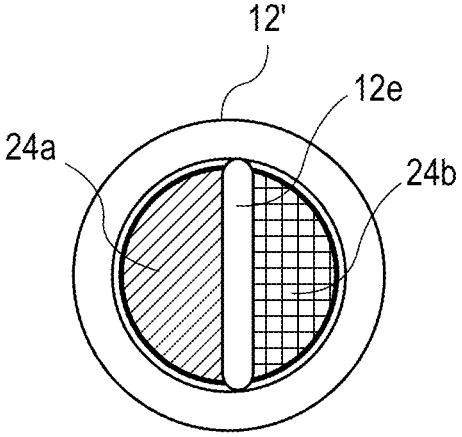

FIG. 7B depicts a cross section view of the handle 12' along line B-B' of FIG. 7A. FIG. 7C depicts a cross section view of the handle 12' along the line B-B' when a toothpaste refill 24*a* and a tooth whitener refill 24*b* are loaded into the handle. Referring to FIGS. 3A, 3B, and 3C, the handle 12' includes a dispensing button 12*a* located on a surface of the handle, a cap 12*b* disposed at one end of the handle, and a first cavity 12*c* and a second cavity 12*d* extending along the length of the handle and separated by a wall 12*e*. The first cavity 12*c* is designed to hold the toothpaste refill 24*a*, and the second cavity 12*d* is designed to hold the tooth whitener refill 24*b*.

The cap 12*b*, which may be located at one end of the handle 12', encloses the toothpaste refill 24*a* and the tooth whitener refill 24*b* in the respective first and second cavities 12*c*/12*d*. In one embodiment (not shown), the dispensing button 12*a* may be mechanically coupled to a plunger mechanism in the cap 12*b*. The plunger mechanism may include, for example, a spring-loaded mechanism, a screw driven piston mechanism, etc. When a user presses the dispensing button 12*a* with a finger (e.g., the thumb), the plunger mechanism travels by a predetermined distance along the cavities 12*c*/12*d* and pushes a predetermined amount of the toothpaste and the tooth whitener through the cavities 12*c*/12*d*/14*c* and out of the hole 14*d*.

In an alternative embodiment, the toothpaste refill 24*a* and the tooth whitener refill 24*b* need not be separately provided and may be combined into a single refill. Accordingly, in the alternative embodiment, the wall 12*e* may be omitted and the cavities 12*c*/12*d* may be merged into a single cavity.

In the preceding specification, the inventive concept has been described with reference to specific exemplary embodiments. It will, however, be evident that various modifications and changes may be made without departing from the broader spirit and scope of the inventive concept as set forth in the claims that follow. The specification and drawings are accordingly to be regarded as illustrative rather than restrictive. Other embodiments of the inventive concept may be apparent to those skilled in the art from consideration of the specification and practice of the concept disclosed herein.

What is claimed is:

1. A toothbrush comprising:

a handle;

a head piece including a base that is made of a flexible material, the head piece having a first side that is closest to the handle and a second side and a third side that are substantially perpendicular to the first side that touching opposite ends of the first side; and a first set of tooth cleaning elements arranged in a first row, a second set of tooth cleaning elements arranged in a second row, wherein the first row and the second row extend parallel to the first side; wherein each row being parallel to one another and intersecting the second side and the third side;

the first set of tooth cleaning elements extending from the base and including no more than two subsets; an orthogonal subset of the first set of tooth cleaning elements that extends orthogonally to the base, and an inclined subset of the first set of tooth cleaning elements that is inclined toward the second side; and the second set of tooth cleaning elements extending from the base and including no more than two subsets; an orthogonal subset of the second set of tooth cleaning elements that extends orthogonally to the base, and an inclined subset of the second set of tooth cleaning elements that is inclined toward the third side.

2. The toothbrush of claim 1, wherein the flexible material is an elastic material.

3. The toothbrush of claim 1, wherein the flexible material comprises silicone.

4. The toothbrush of claim 1, wherein the base has a first face and a second face, and the tooth cleaning elements are disposed on the first face of the flexible material and extend from the first face of the flexible material at the angle α relative to the first face.

5. The toothbrush of claim 1, wherein the first set of tooth cleaning elements and the second set of tooth cleaning elements are arranged in odd-numbered rows and even-numbered rows parallel to the first row, wherein the inclined subset of the first set of tooth cleaning elements in odd-numbered rows make the angle α with respect to the base and the inclined subset of the second set of tooth cleaning elements in even-numbered rows make the angle (180-α) with respect to the base.

6. The toothbrush of claim 1 further comprising a top set of tooth cleaning elements disposed on a first face of the flexible material and a bottom set of tooth cleaning elements disposed on a second face of the flexible material that is opposite the first face.

7. The toothbrush of claim 6, wherein the tooth cleaning elements on the second surface are symmetric with the tooth cleaning elements on the first surface with respect to a plane of the base.

8. The toothbrush of claim 1, wherein the tooth cleaning elements have different lengths.

9. The toothbrush of claim 8, wherein tips of the tooth cleaning elements extending from the first face form a rooftop outline that includes two lines intersecting at an angle to form an apex that extends along a center of the flexible material.

10. The toothbrush of claim 1, wherein the tooth cleaning elements comprise:

a core; and a plurality of bristles surrounding the core, wherein the core is thicker than each of the bristles.

11. A toothbrush comprising:

a handle;

a base attached to the handle and including a flexible material, the base having a first side that is closest to the handle;

first tooth cleaning elements that extend substantially orthogonally with respect to the flexible material;

first inclined tooth cleaning elements extending from the flexible material and leaning at a first angle toward a second side of the base that is substantially perpendicular to the first side, the first inclined tooth cleaning elements arranged in a first row that is parallel to the first side; and second inclined tooth cleaning elements extending from the flexible material and leaning at a second angle toward a third side of the base that is substantially perpendicular to the first side; the second inclined tooth cleaning elements arranged in a second row that is parallel to the first side, wherein no tooth cleaning element in the first row leans toward the third side; and no tooth cleaning elements in the second row leans toward the second side;

wherein each row being parallel to one another and intersecting the second side and the third side.

12. The toothbrush of claim 11, wherein the first inclined tooth cleaning elements have different lengths.

13. The toothbrush of claim 11, wherein the first inclined tooth cleaning elements extend to form an angle $\alpha$ with respect to the flexible material, the angle $\alpha$ being between about 20° and about 70°.

14. The toothbrush of claim 13, wherein the first inclined tooth cleaning elements extend to form an angle $\alpha$ with respect to the flexible material, and the second inclined tooth cleaning elements extend to form an angle (180-$\alpha$) with respect to the flexible material.

15. The toothbrush of claim 14 further comprising second tooth cleaning elements extending substantially orthogonally with respect to the flexible material and arranged in different rows than the first tooth cleaning elements.

16. The toothbrush of claim 15, wherein the first inclined tooth cleaning elements are arranged in same rows as the first tooth cleaning elements, and the second inclined tooth cleaning elements are arranged in same rows as the second tooth cleaning elements such that the first tooth cleaning elements and the second tooth cleaning elements are in mutually exclusive rows on the head piece.

* * * * *